US009510630B2

(12) United States Patent
Lawrence

(10) Patent No.: US 9,510,630 B2
(45) Date of Patent: Dec. 6, 2016

(54) DISPOSABLE UNDERARM PERSPIRATION PAD

(76) Inventor: Gregory Michel Lawrence, Chandler, AZ (US)

( * ) Notice: Subject to any disclaimer, the term of this patent is extended or adjusted under 35 U.S.C. 154(b) by 330 days.

(21) Appl. No.: 13/068,687

(22) Filed: May 17, 2011

(65) Prior Publication Data

US 2012/0291175 A1 Nov. 22, 2012

Related U.S. Application Data

(60) Provisional application No. 61/395,484, filed on May 14, 2010.

(51) Int. Cl.
*A41D 27/13* (2006.01)

(52) U.S. Cl.
CPC ..... *A41D 27/136* (2013.01)

(58) Field of Classification Search
CPC ..... A41D 27/13; A41D 27/136
USPC ..... 2/53, 56, 113, 54
See application file for complete search history.

(56) References Cited

U.S. PATENT DOCUMENTS 397,570 A * 2/1889 Southworth ..... 2/267
519,487 A * 5/1894 Warner ..... 2/56
815,186 A * 3/1906 Lockie ..... 2/55
855,638 A * 6/1907 Jackson ..... 2/56
1,108,427 A * 8/1914 Brennan ..... A41D 27/13 2/53
1,122,113 A * 12/1914 Hausner ..... 2/55
1,137,452 A * 4/1915 Beinstock ..... 2/55
1,257,617 A * 2/1918 Lee ..... 2/56
1,348,754 A * 8/1920 Shrader ..... 2/55
1,477,218 A * 12/1923 Guinzburg ..... 2/105
1,550,799 A * 8/1925 Sinclair ..... 450/30
2,028,599 A * 1/1936 Goodman ..... 2/73
2,115,333 A * 4/1938 Isaae ..... 2/56
2,309,601 A * 1/1943 Kneibler ..... 2/113
2,886,820 A * 5/1959 Morris ..... 2/54
2,911,647 A * 11/1959 Dixon ..... A41D 27/13 2/53
3,019,443 A 2/1962 Rose
3,421,514 A * 1/1969 Friedlander ..... 450/30
3,588,916 A * 6/1971 Glatt ..... 2/53
3,727,237 A * 4/1973 Glatt ..... 2/56
3,885,247 A 5/1975 Kost
4,545,080 A * 10/1985 Gorham ..... 2/54
4,631,752 A 12/1986 Heyman
4,747,162 A * 5/1988 Yanagihara ..... 2/53
D298,081 S 10/1988 Gieseke
4,856,111 A 8/1989 Sholes
4,892,535 A * 1/1990 Bjornberg et al. ..... 604/380
5,042,088 A 8/1991 Sherrod
5,570,471 A * 11/1996 Krawchuk ..... 2/53
5,790,982 A * 8/1998 Boutboul et al. ..... 2/53
6,138,276 A * 10/2000 Asciutto et al. ..... 2/53
6,178,557 B1 * 1/2001 Bel Monte ..... 2/60

(Continued)

*Primary Examiner* — Richale Quinn
(74) *Attorney, Agent, or Firm* — Schmeiser, Olsen & Watts LLP

(57) ABSTRACT

A Disposable Underarm Perspiration Pad that comprises a light-weight moisture wicking and absorptive material that is worn as a perspiration shield between a person's underarm and the next level of outer garment is presented. The inventive device is configured to enable attachment to the upper bicep area of the arm and concealment under the outer garment while at the same time providing wearing comfortability to the user. Attachment to the upper bicep area of the arm can be accomplished with a fixed or adjustable member.

10 Claims, 6 Drawing Sheets

(56) References Cited

U.S. PATENT DOCUMENTS

| | | | | |
|---|---|---|---|---|
| 6,347,407 | B1 * | 2/2002 | Dowell | 2/113 |
| 6,430,748 | B1 * | 8/2002 | Burkhart | 2/78.1 |
| D467,706 | S * | 12/2002 | Thompson | D2/861 |
| 6,591,425 | B1 * | 7/2003 | Zellers | 2/54 |
| 6,618,859 | B1 | 9/2003 | Kadymir | |
| D535,032 | S * | 1/2007 | Bendjy | D24/189 |
| 7,730,551 | B2 * | 6/2010 | Price | 2/53 |
| 2002/0032420 | A1 * | 3/2002 | Taylor | 604/359 |
| 2006/0085886 | A1 | 4/2006 | Williams | |
| 2006/0090239 | A1 * | 5/2006 | Koppen | 2/53 |
| 2007/0006358 | A1 | 1/2007 | Rey | |
| 2007/0150995 | A1 | 7/2007 | Luna | |
| 2007/0174943 | A1 * | 8/2007 | Reeves | 2/53 |
| 2009/0018518 | A1 | 1/2009 | Bunelli | |
| 2010/0263102 | A1 | 10/2010 | Trespalacios | |

* cited by examiner

DISPOSABLE UNDERARM PERSPIRATION PAD

This application claims priority to U.S. Provisional Application Ser. No. 61/395,484 filed May 14, 2010 entitled, "Disposable Underarm Perspiration Pad"

BACKGROUND OF INVENTION

The body does many things in an attempt to maintain a very comfortable core body temperature. When the body is cold, the blood vessels at the skin level constrict in an attempt to reduce the body heat loss and when the body temperature exceeds the comfortable core body temperature, the body's built in sensors triggers it to start sweating (perspiring) in an attempt to cool its temperature down. Although many areas of the body sweat, the underarm area is one of the areas that is known to sweat the most when the body gets hot. Male as well as females sweat under their armpits, some people more than others. Although sweating helps to cools the body off, it also has a negative side effect that could cause staining of any fabric that comes in direct contact with it over time. This dis-coloration condition can be compounded and made worst when an anti-perspirant is used in the underarm area as a control mechanism for perspiration. This invention "Disposable Underarm Perspiration Pad" provides a barrier medium that protects the next outer garment layer of clothing from direct contact with the perspiration while at the same time allowing the wearer total freedom of movement using the arms.

The Disposable Underarm Perspiration Pad is intended to be worn by a person, male or female, who would like to have a means of protecting the underarm areas of their clothing from perspiration stains. It is preferred that the Disposable Underarm Perspiration Pad be constructed of a lightweight material and fashioned into a pad type form that can be worn under each armpit. The pad can be fashioned in such a way to allow it to be secured to the body by either an elastic band or a hook and loop fastener, such as one made by Velcro USA, Manchester, N.H. and sold under the brand name Velcro® (as used throughout, reference to Velcro® is meant to mean and include a hook and loop fastener. When the Disposable Underarm Perspiration Pad is secured as intended in the under armpit area, it absorbs the perspiration and keeps the garment immediately next to the Disposable Underarm Perspiration Pad, free of perspiration stains.

SUMMARY OF INVENTION

The Disposable Underarm Perspiration Pad comprises lightweight moisture wicking and absorptive materials that could be worn as a perspiration shield between a person's underarm (armpits) and the next level of outer garment. The Disposable Underarm Perspiration Pad is fashioned so that it could be concealed under the next layer of garment while at the same time providing wearing comfortability to the user by not being big and bulky. The Disposable Underarm Perspiration Pad can be secured in the underarm area using an elastic band or a hook and loop fastener, such as one made by Velcro USA, Manchester, N.H. and sold under the brand name Velcro® (as used throughout, reference to Velcro® is meant to mean and include a hook and loop fastener. that is attached to the Disposable Underarm Perspiration Pad and fashioned to allow attachment to the upper bicep area of the arm. This novel invention, the Disposable Underarm Perspiration Pad, can give the wearer of sleeved outer garments a sense of confidence to know that their outer garment, in the underarm area, will be protected from underarm fabric staining due to perspiration. This invention is ideal for a person desiring garment protection in the underarm area of clothing such as a shirt, blouse, T-shirt, coat, and the likes when undershirt type of garments are not worn to provide that layer of protection.

DETAILED DESCRIPTION

It is the intended vision of this invention, the Disposable Underarm Perspiration Pad, to be worn by either males or females and to be concealed under any sleeved upper body clothing garments that do not have fishnet, mesh, web, transparent or the like types of fabrics in the shoulder and underarm areas. It is preferred that the Disposable Underarm Perspiration Pad be constructed using moisture wicking and lightweight absorptive materials and be as non-bulky as possible to maximize the comfortability during wearing. The absorptive material can be such that it has the ability to absorb moderate levels of underarm perspiration. The wearer of the Disposable Underarm Perspiration Pad will have the freedom of knowing that their immediate layer of outer garment worn against the Disposable Underarm Perspiration will be protected from fabric staining in the underarm area due to perspiration.

Figure 1:
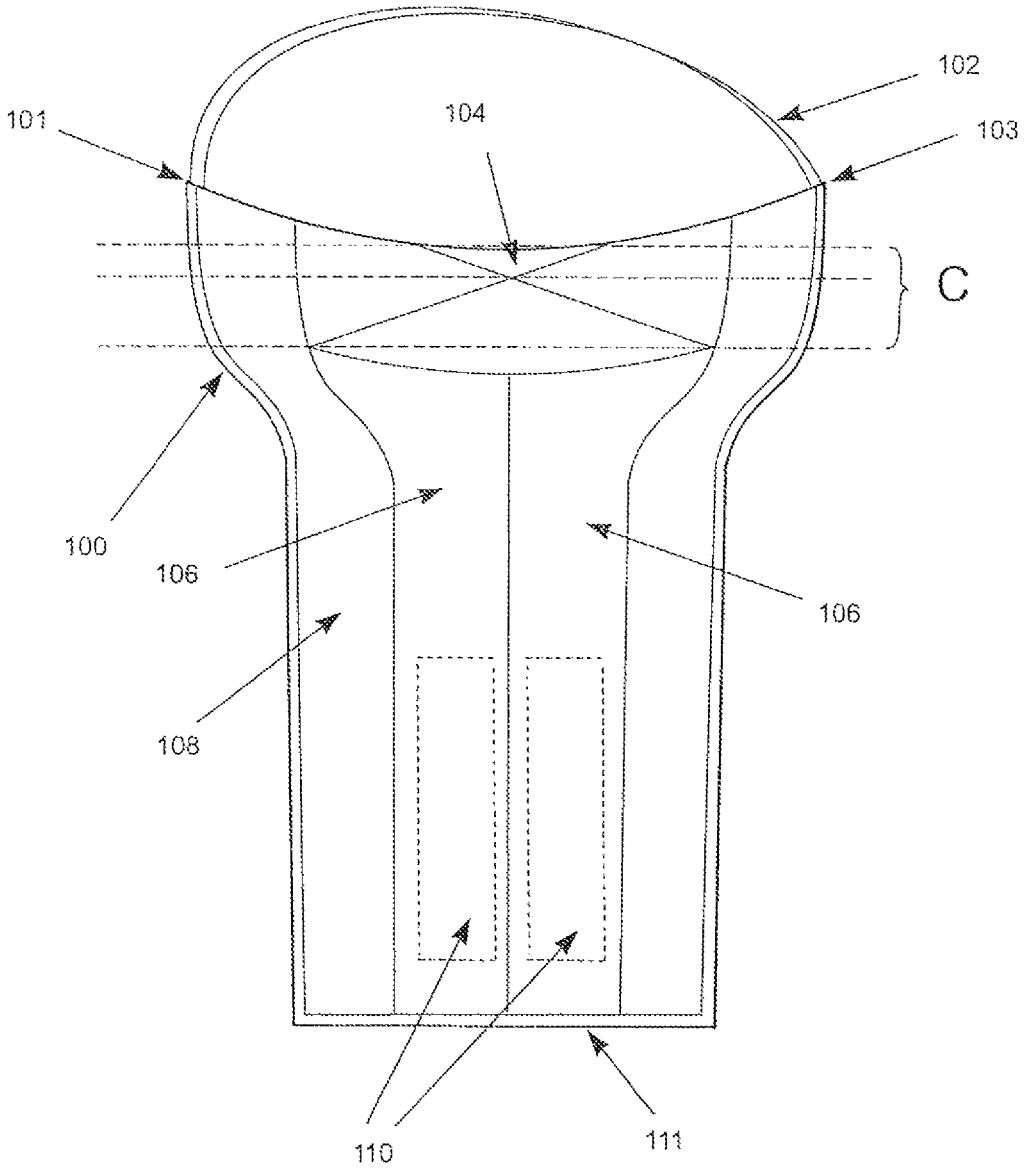
FIG. 1 depicts the inventive device with an elastic attaching band, 2-thin pieces of flexible plastic inside the fabric, different moisture absorbing regions: upper-center, lower-middle, and lower-outer. Also shown are the recommended sewing patterns.

Referring to FIG. 1, the Disposable Underarm Perspiration Pad 100 is shown. As shown, the Disposable Underarm Perspiration Pad 100 is fashioned in such a manner that allows it to be effectively worn comfortably in the underarm pit area, next to the skin, under an outer garment (see FIGS. 3,4; described in more detail below. This embodiment shows a thin elastic band 102 that is looped across the top of the upper pad edges and extends from the pad top left edge 101 to the pad top right edge 103 that will be used to anchor the said pad to the upper portion of the bicep (FIGS. 3 and 4; "A"). The wearer of said pad would simply slide their arm through the elastic band 102 loop until the elastic band 102 is positioned slightly above the bicep A which simultaneously positions the Disposable Underarm Perspiration Pad

Figure 3:
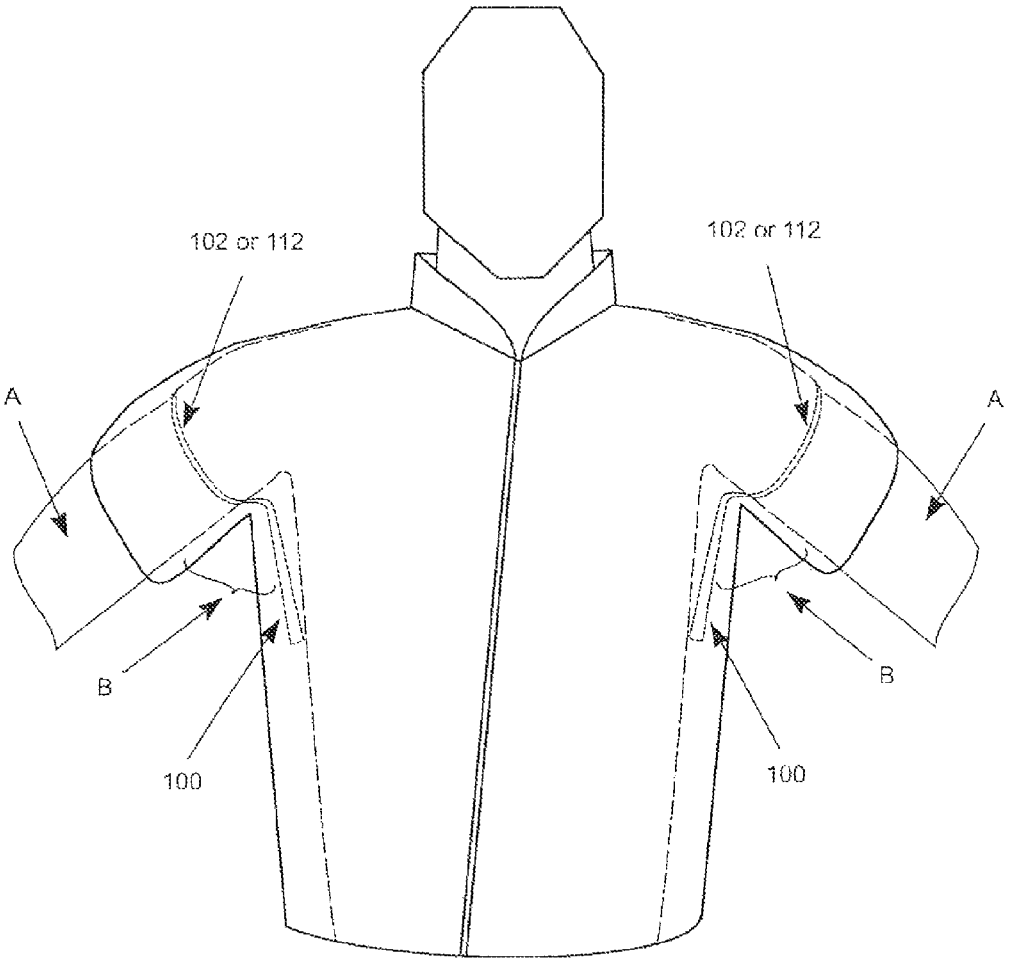
FIG. 3 shows a front view of an embodiment where the person is wearing a shirt as an outer garment and the Disposable Underarm Perspiration Pads are worn in their intended positions beneath the shirt.
Figure 4:
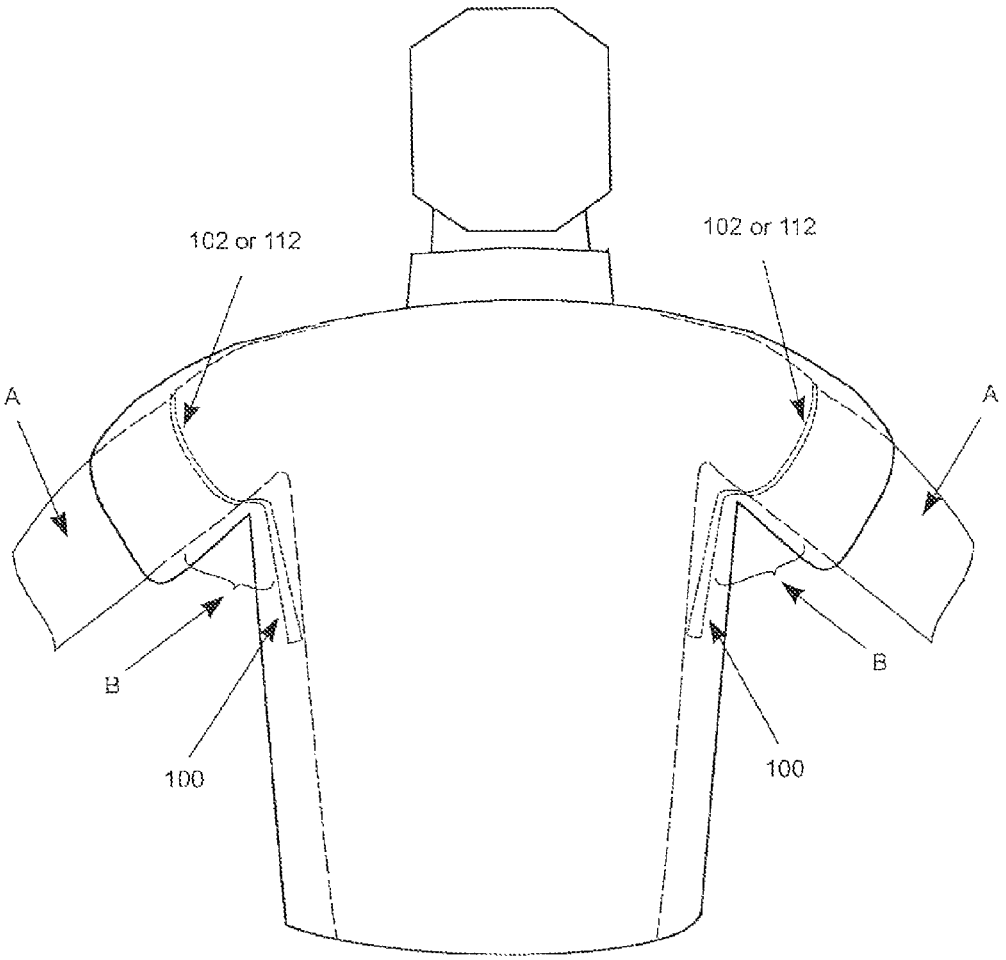
FIG. 4 shows a back view of FIG. 3 embodiment where the person is wearing a shirt as an outer garment and the Disposable Underarm Perspiration Pads being worn in their intended positions beneath the shirt.

100 in the preferred position within the arm-pit area of the underarm (FIGS. 3 and 4; "B"). Once this same procedure is repeated for the remaining arm, the wearer of the said pads is ready to put on the outer garment and gain all the benefits of wearing the Disposable Underarm Perspiration Pad(s) 100.

Also shown in FIG. 1 are the different absorbing regions upper-center 104, lower-middle 106, and lower-outer 108. The upper-center region 104 can be configured to have more internal padding than the lower-middle region 106 and lower-outer region 108 because the upper-center region 104 will be the area positioned directly in the armpit area. It is preferred that the bottom edge 111 of the Disposable Underarm Perspiration Pad 100 has no anchoring point so it can hang freely beneath the immediate next layer of outer garment. The free hanging of the Disposable Underarm Perspiration Pad 100 not only aids in comfortability and wear-ability, it also allows for ventilation between the body and Disposable Underarm Perspiration Pad 100.

FIG. 1 shows the preferred stitching pattern for the different regions upper-center 104, lower-middle 106, and lower-outer 108 that can be used to channel the moisture absorption of the Disposable Underarm Perspiration Pad 100. The upper-center 104 region is stitched in a semi-rectangular configuration with two slanted stitched lines, one left to right and the other right to left crossing to form an off-horizontal axis XC. It is preferred that the absorbing material in this region be thicker than the material used in the lower-middle 106 and lower-outer 108 regions. The stitching pattern can be vertical for the lower-middle 106 and lower-outer 108 regions to assist in said pad's ability to not fold easily while being worn. To also aid in giving said pad a degree of stiffness in the lower region, two very thin flexible plastic sleeves 110 can be sewn within the pad material. It is preferred that these flexible plastic sleeves be positioned vertically and sewn inside of the lower-middle 106 region on both sides of the vertical center.

Figure 2:
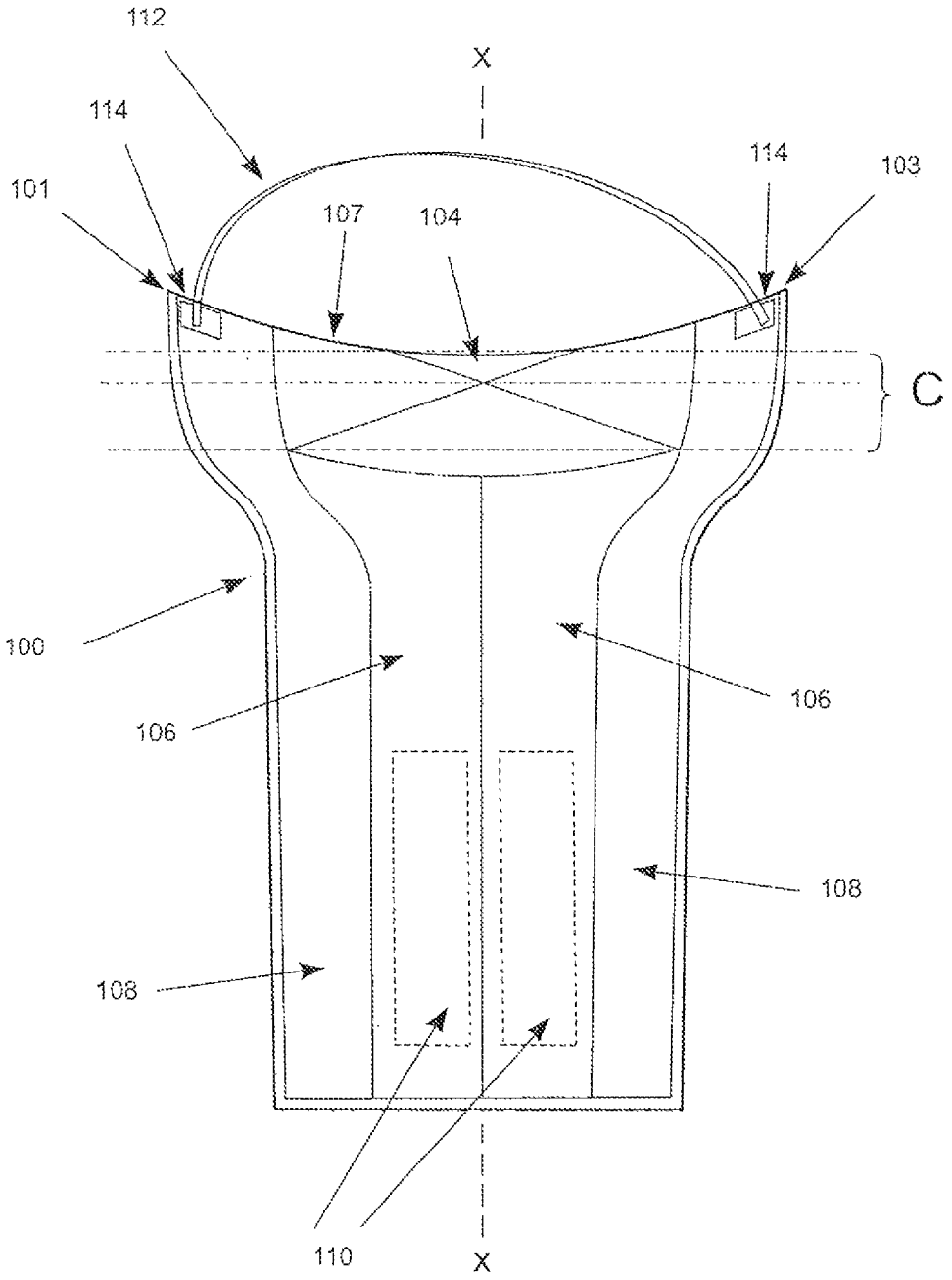
FIG. 2 depicts the inventive device with an attaching band made from a thin piece of Velcro® (soft side), the Velcro® connecting tabs (the mini-J hook side), 2-thin pieces of flexible plastic inside the fabric, different moisture absorbing regions: upper-center, lower-middle, and lower-outer. Also shown are the recommended sewing patterns.

FIG. 2 shows an embodiment of the Disposable Underarm Perspiration Pad 100 configured with a thin Velcro® band 112 that is looped across the top 107 of said pad edges 101, 103, starting at the J-hook 114 attached to the pad top left edge and extending to the pad top right edge connecting to the right Velcro® connector (J-hook) 114. The Velcro® band will be used to anchor said pad to the wearer's upper bicep portion. As shown, the Disposable Underarm Perspiration Pad 120 is fashioned in such a manner that allows it to be easily concealed under an outer garment next to the skin in the underarm area and worn comfortably. The wearer of this embodiment of the Disposable Underarm Perspiration Pad 100 would simply attach one sides of the Velcro® band 112 to the J-hook 114 and loop band 112 over the upper bicep area where the other end of the band 112 will be connected to that sides J-hook connector 114 as tight as needed. Anchoring the band 112 above the bicep positions the Disposable Underarm Perspiration Pad 120 in the preferred position within the armpit area of the underarm.

Referring to FIG. 2, it shows the different absorbing regions for absorbing moisture namely, upper-center 104, lower-middle 106, and lower-outer 108. The upper-center region 104 can contain more internal padding than the lower-middle 106 and lower-outer 108 regions because the upper-center region 104 will be the area positioned directly in the armpit area. It is preferred that the bottom of the Disposable Underarm Perspiration Pad 120 be allowed to hang freely beneath the next layer of outer garment and not having no anchoring point. The free hanging of the Disposable Underarm Perspiration Pad 120 not only aids in comfortability and wearability; but, also allows for adequate ventilation between the body and the Disposable Underarm Perspiration Pad 120.

FIG. 2 shows the preferred stitching pattern for the different regions upper-center 104, lower-middle 106, and lower-outer 108 that can be used to channel the moisture absorption of the Disposable. Underarm Perspiration Pad 100. The upper-center 104 region is stitched in a semi-rectangular configuration with two slanted stitched lines, one left to right and the other right to left crossing to form an off-horizontal axis X. It is preferred that the absorbing material in this region be thicker than the material used in the lower-middle 106 and lower-outer 108 regions. The stitching pattern can be vertical for the lower-middle 106 and lower-outer 108 regions to assist in said pad's ability to not fold easily while being worn. To also aid in giving said pad a degree of stiffness in the lower region, two very thin flexible plastic sleeves 110 can be sewn within the pad material. It is preferred that these flexible plastic sleeves be positioned vertically and sewn inside of the lower-middle 106 region on both sides of the vertical center X.

FIG. 3 shows a front view of an embodiment of the Disposable Underarm Perspiration Pad's (U100, 120) being worn by a person wearing an outer garment. As can be seen in this view, the Disposable Underarm Perspiration Pads 100, 120 are being worn in their preferred and intended position beneath the garment. Also can be seen are anchoring mediums which could be either an elastic band 102 or Velcro® band 112 that anchors said pad to the upper bicep area. As shown in the FIG. 3 the Disposable Underarm Perspiration Pad's 100 or 120, depending on the embodiment, are hanging freely. For the embodiment using the Velcro® band 112 and connecting tabs 114 as the attaching element, the Velcro® band 112 should be worn on the wearer's upper bicep area in a fashion that allows the "soft fiber side" of the Velcro® band 112 to be worn facing the skin. The Velcro® band 112 embodiment can accommodate many unique sizes. In general, when a wearer of the Disposable Underarm Perspiration Pad 100 or 120 wears an outer garment (shirt, coat, blouse, dress, T-shirt, etc.), the said pads gets positioned closer to the body and rests in the desired and intended position between the armpit and the wearer's garment. When the underarm (armpit) area sweats, the said pads absorb the moisture. Because said pads are hanging freely and not anchored at the bottom, the area around said pads receives adequate ventilation to the point that any moisten pad with sweat will eventually dry. The looser the outer garment, the looser the Disposable Underarm Perspiration Pads 102 fits snuggly against the armpit area of the body which allows more ventilation in the underarm pit areas.

FIG. 4 shows a back view where the person is wearing an outer garment and the Disposable Underarm Perspiration Pads are being worn in their intended position beneath the garment.

Figure 5:
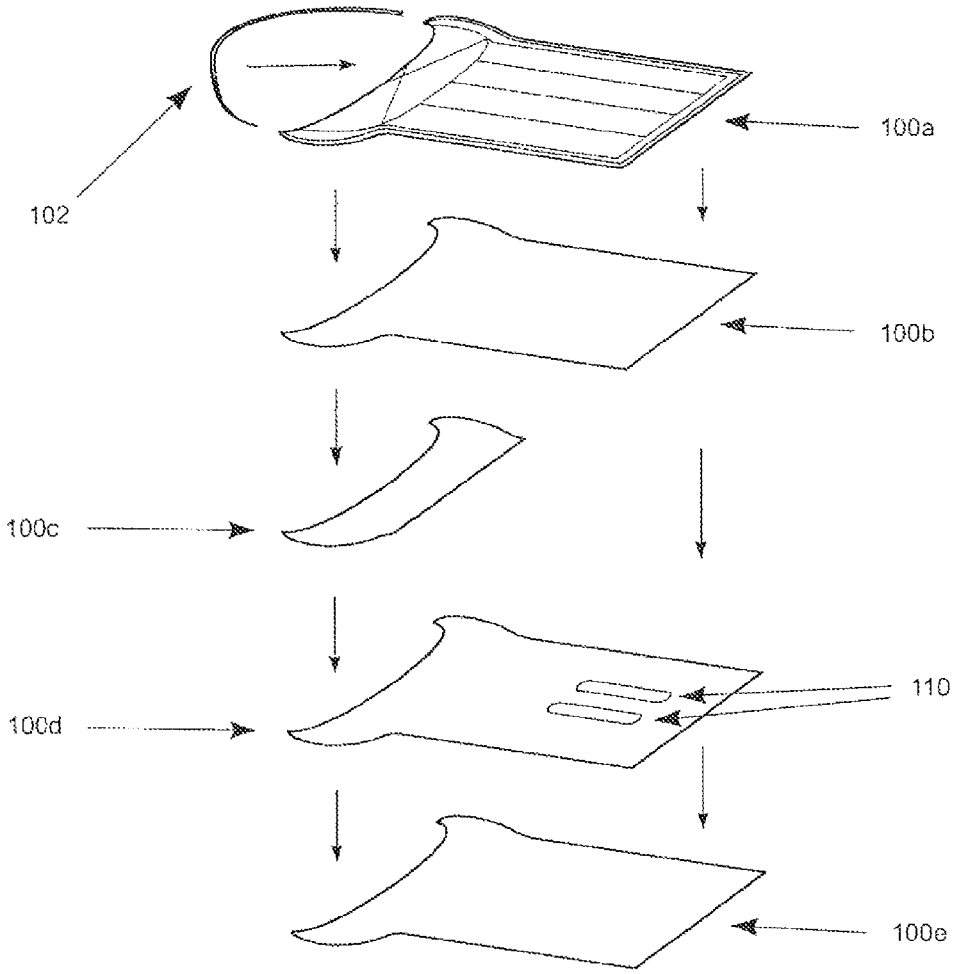
FIG. 5 depicts the inventive device (with an elastic band as the attaching element) in an expanded view of components.

FIG. 5 shows an expanded view of components of the Disposable Underarm Perspiration Pad 100 (shown in FIG. 1). The Disposable Underarm Perspiration Pad 100 contains multiple layers of material namely moisture wicking outer layer 100*a*, moisture absorptive material sheet(s) 100*b*-100*d*, moisture wicking outer back layer 100*e*, 2—very thin flexible plastic sleeves, and an elastic attaching band 102. These materials get sandwiched and sewn together to produce the embodiment of the Disposable Underarm Perspiration Pad 100 as shown in FIG. 1. For wear-ability and comfortability, it is preferred that the Disposable Underarm Perspiration Pad 100 be constructed of light-weight moisture wicking and non-bulky absorptive materials.

Referencing FIG. 5 100*a*, this shows the top layer of the Disposable Underarm Perspiration Pad 100*a* be made of a light-weight non-bulky moisture wicking type of material capable of being worn without sloughing or shedding due to the continuous rubbing contact against the outer garment and the skin. The preferred stitching patterns for the different regions upper-center 104, lower-middle 106 and lower-outer 108 are defined on this top layer 100*a*. These stitching patterns are intended to define the internal channels for moisture absorption in the different regions of said pad at all the layer. The thin elastic band 102 gets attached as shown in FIG. 5. The length of this band will vary depending on the size of said pad (small, medium, large, or extra large). In either case, the wearer of the said pad should choose a size that suits their need and ensure that the elastic band 102 does not fit too tight around the upper bicep area of the arms. Referencing FIG. 5 100*b*, this layer or layers can contain one more absorptive material sheet(s) depending on the absorbency capability of the sheet(s). It is preferred that not more than three sheets of absorptive material be used at this layer. Too many sheets will add to the bulkiness of said disposable pad and also affect the wearing comfortability. Referencing FIG. 5 100*c*, this layer can be fashioned as shown and preferably should contain more absorbing material than the lower-middle 106 and lower-outer 108 regions because the said pad area will be positioned directly in the armpit area. To achieve the desired thickness at this layer, no less than to sheets and not more than four sheets of light-weight absorptive material can be used. Referencing FIG. 5 100*d*, this layer shows another layer that can also contain more absorptive material. For said layer, not less than one but preferably not more than three sheets should be used. Also shown in FIG. 5 100*d* are two very thin flexible plastic sleeves 110 positioned toward the middle in the lower-middle 106 region. The regions get defined and the flexible plastic sleeves 110 get fixed into their position as all the layers are sewn together. These two very thin flexible plastic sleeves give the Disposable Underarm Perspiration Pad 100 a degree of stiffness in the lower pad region and along with the vertical stitching patterns, reduces the tendency for the said pad to fold-up or roll-up in the underarm pit area while being worn. Referencing FIG. 5, 100*e*, this layer shows the back of the Disposable Underarm Perspiration Pad 100 and it is preferred that it be constructed of the same light-weight moisture wicking material used on FIG. 5 100*a* front layer.

Figure 6:
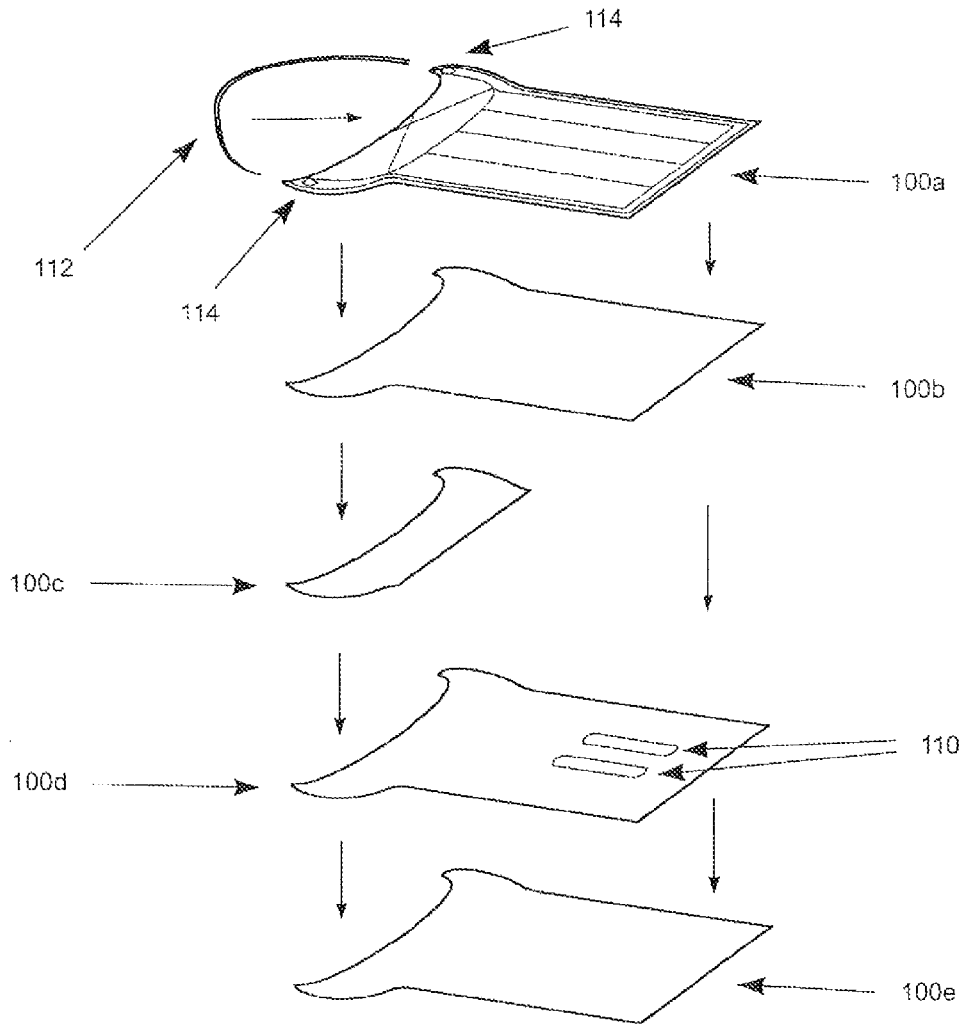
FIG. 6 shows an embodiment of the Disposable Underarm Perspiration Pad (with a Velcro® band as the attaching element) in an expanded view of components.

FIG. 6 shows an expanded view of components of the Disposable Underarm Perspiration Pad 100 embodiment (with a Velcro® band 112 as the attaching element). FIG. 6 shows that the Disposable Underarm Perspiration Pad 100 contains multiple layers of material namely moisture wicking outer layer 100*a*, moisture absorptive material sheet(s) 100*b*-100*d*, moisture wicking outer back layer 100*e*, and two very thin flexible plastic sleeves 110. These materials get sandwiched and sewn together to produce the embodiment of the Disposable Underarm Perspiration Pad 100 as shown in FIG. 2. For wear-ability and comfortability, it is preferred that the Disposable Underarm Perspiration Pad 100 be constructed of light-weight moisture wicking and non-bulky absorptive materials.

Referencing FIG. 6 100*a*, this shows the top layer of the Disposable Underarm Perspiration Pad 120. It is preferred that this layer 100*a* be made of a light-weight non-bulky moisture wicking type of material capable of being worn without sloughing or shedding due to the continuous rubbing contact against the outer garment and the skin. The preferred stitching patterns for the different regions upper-center 104, lower-middle 106 and lower-outer 108 as mentioned in Sections [0011] are defined on this top layer 120*a*. These stitching patterns are intended to define the internal channels for moisture absorption in the different regions of said pad at all the layer. A Velcro® (J-hook) connector 114 gets attached on both sides of said pad as shown in FIG. 6. The Velcro® band eventually gets attached to these Velcro® (J-hook) connector(s) 114. The length of said band will vary depending on wearer's discretion. Referencing FIG. 5 100*b*, this layer(s) can contain one or more absorptive material sheet(s) depending on the absorbency capability of the sheet(s). It is preferred that not more than three sheets of absorptive material be used at this layer. Too many sheets will add to the bulkiness of said disposable pad and also affect the wearing comfortability. Referencing FIG. 6 100*c*, this layer can be fashioned as shown and preferably should contain more absorbing material than the lower-middle 106 and lower-outer 108 regions because this portion of said pad area will be positioned directly in the armpit area. To achieve the desired thickness at this layer, no less than two sheets and not more than four sheets of light-weight absorptive material can be used. Referencing FIG. 6 100*d*, this layer shows another layer that can also contain more absorptive material. For this said layer, not less than one but preferably not more than three sheets should be used. Also shown in FIG. 6 100*d* are two very thin flexible plastic sleeves 110 positioned toward the middle in the lower-middle 106 region. The regions get defined and the flexible plastic sleeves 110 get fixed into their position when all the layers are sewn together. These two very thin flexible plastic sleeves give the Disposable Underarm Perspiration Pad 100*d* a degree of stiffness in the lower pad region and along with the vertical stitching patterns reduces the tendency for the said pad to fold-up or roll-up in the underarm pit area while being worn. Referencing FIG. 6, 100*e*, this layer shows the back of the Disposable Underarm Perspiration Pad 100 and is preferred to be constructed of the same light-weight moisture wicking material used on FIG. 6 100*a* front layer.

I claim:

1. An underarm perspiration pad comprising an elongated pad having an upper edge comprising a top left edge and a top right edge, a lower edge, an inner side, and an outer side, and a band operating as the only anchoring point, the band comprising a first end and a second end, the band first end affixed to the upper edge at the top left edge and the band second end affixed to the upper edge at the top right edge, the band being configured to adapted to fit the circumference of an upper arm, wherein the elongate pad comprises an upper-center absorbent region having stitching formed in a semi-rectangular shape with two slanted stitched lines to form an X shape to operate as channels for moisture absorption, a lower-middle absorbent region and a lower-outer absorbent region, wherein the lower-middle region and the lower-outer region include vertical stitches to form channels for moisture absorption and to reduce folding of the lower-middle region and lower-outer region, and wherein the elongated pad contains thin flexible plastic strips positioned vertically and sewn within the middle of the lower-middle absorbent region adjacent a center line of the elongate pad, wherein the thin flexible strips maintain the perspiration pad in an elongate position.

2. The perspiration pad of claim 1 wherein the elongated pad is made from lightweight material.

3. The perspiration pad of claim 1 wherein the elongated pad is made from moisture wicking material.

4. The perspiration pad of claim 1 wherein the elongated pad includes multiple layers of light-weight absorptive material.

5. The perspiration pad of claim 1, wherein the upper-center absorbent region comprises absorbing material that is thicker than absorbing material of the lower-middle absorbent region and the lower-outer absorbent region.

6. An underarm perspiration pad comprising an elongated pad having an upper edge comprising a top left edge and a top right edge, a lower edge, an inner side, and an outer side, and a band operating as the only anchoring point, the band comprising a first portion further comprising a first end affixed to the upper edge at the top left edge and a second end and a second portion further comprising a first end affixed to the upper edge at the top right edge and a second end, the first portion second end and the second portion second end being adapted to reversibly join to one another, wherein the elongate pad comprises an upper-center absorbent region having stitching formed in a semi-rectangular shape with two slanted stitched lines to form an X shape to operate as channels for moisture absorption, a lower-middle absorbent region and a lower-outer absorbent region, wherein the lower-middle region and the lower-outer region include vertical stitches to form channels for moisture absorption and to reduce folding of the lower-middle region and lower-outer region, and wherein the elongated pad contains thin flexible plastic strips positioned vertically and sewn within the middle of the lower-middle absorbent region adjacent a center line of the elongate pad, wherein the thin flexible strips maintain the perspiration pad in an elongate position.

7. The perspiration pad of claim 6 wherein the elongated pad is made from lightweight material.

8. The perspiration pad of claim 6 wherein the elongated pad is made from moisture wicking material.

9. The perspiration pad of claim 6 wherein the elongated pad includes multiple layers of light-weight absorptive material.

10. The perspiration pad of claim 6, wherein the upper-center absorbent region comprises absorbing material that is thicker than absorbing material of the lower-middle absorbent region and the lower-outer absorbent region.

* * * * *